US005547332A

United States Patent [19]

Smith et al.

[11] Patent Number: 5,547,332

[45] Date of Patent: Aug. 20, 1996

[54] TOP MOUNTED CONTAINER HANDLING APPARATUS

[75] Inventors: Fred P. Smith, Alpine; William R. Johnson, American Fork, both of Utah

[73] Assignee: The Heil Company, Chattanooga, Tenn.

[21] Appl. No.: 398,364

[22] Filed: Mar. 3, 1995

Related U.S. Application Data

[62] Division of Ser. No. 36,487, Mar. 24, 1993, Pat. No. 5,419,671.

[51] Int. Cl.[6] ..... B65F 3/04

[52] U.S. Cl. ..... 414/786; 414/408; 414/555

[58] Field of Search ..... 414/406, 408, 414/419, 421, 487, 547, 555, 732–3, 738–9, 786, 917

[56] References Cited

U.S. PATENT DOCUMENTS

| | | | |
|---|---|---|---|
| Re. 34,292 | 6/1993 | Bingman et al. | 414/408 |
| 3,765,554 | 10/1973 | Morrison | 414/408 |
| 4,175,903 | 11/1979 | Carson | 414/408 |
| 4,566,840 | 1/1986 | Smith | 414/408 |
| 4,726,726 | 2/1988 | Dossena et al. | 414/406 X |
| 4,872,801 | 10/1989 | Yeazel et al. | 414/408 X |
| 5,044,863 | 9/1991 | LaBass et al. | 414/408 X |
| 5,092,731 | 3/1992 | Jones et al. | 414/406 |
| 5,391,039 | 2/1995 | Holtom | 414/406 X |

*Primary Examiner*—James W. Keenan

*Attorney, Agent, or Firm*—Parsons & Associates; Don J. Flickinger; Robert A. Parsons

[57] ABSTRACT

A container handling apparatus having a mounting platform a lifting arm extending from the mounting platform and terminating in a gripper mechanism, mounted on top of a body of a refuse collection vehicle and configured to include three four-bar linkages which interact to produce a reach cycle and a hoist cycle.

4 Claims, 4 Drawing Sheets

30
33
34
35
40
42
43
44
45
47
48
49
50
52
53
54
55
56
57
58
61
62
63
64
66
67
68
69
70
72
73
74
75
77
78
79
80
82
83
84
85
87
88
89
90
92
93
95
96
100
102
103
104
105
106
108
109
110
112
113
114
115
116
118
119
120
122
123
124
125
126
127
128
129
130
131
133
134
135
136
137
138
139
140
142
143
144
145
147
148
149
150
152
153
154
155
157
158
159
160
162
163
164
165
167
168
169
170
172
174
175
176
177
178
179
180
182
183
184
185
187
188
189
190
192

FIG. 6
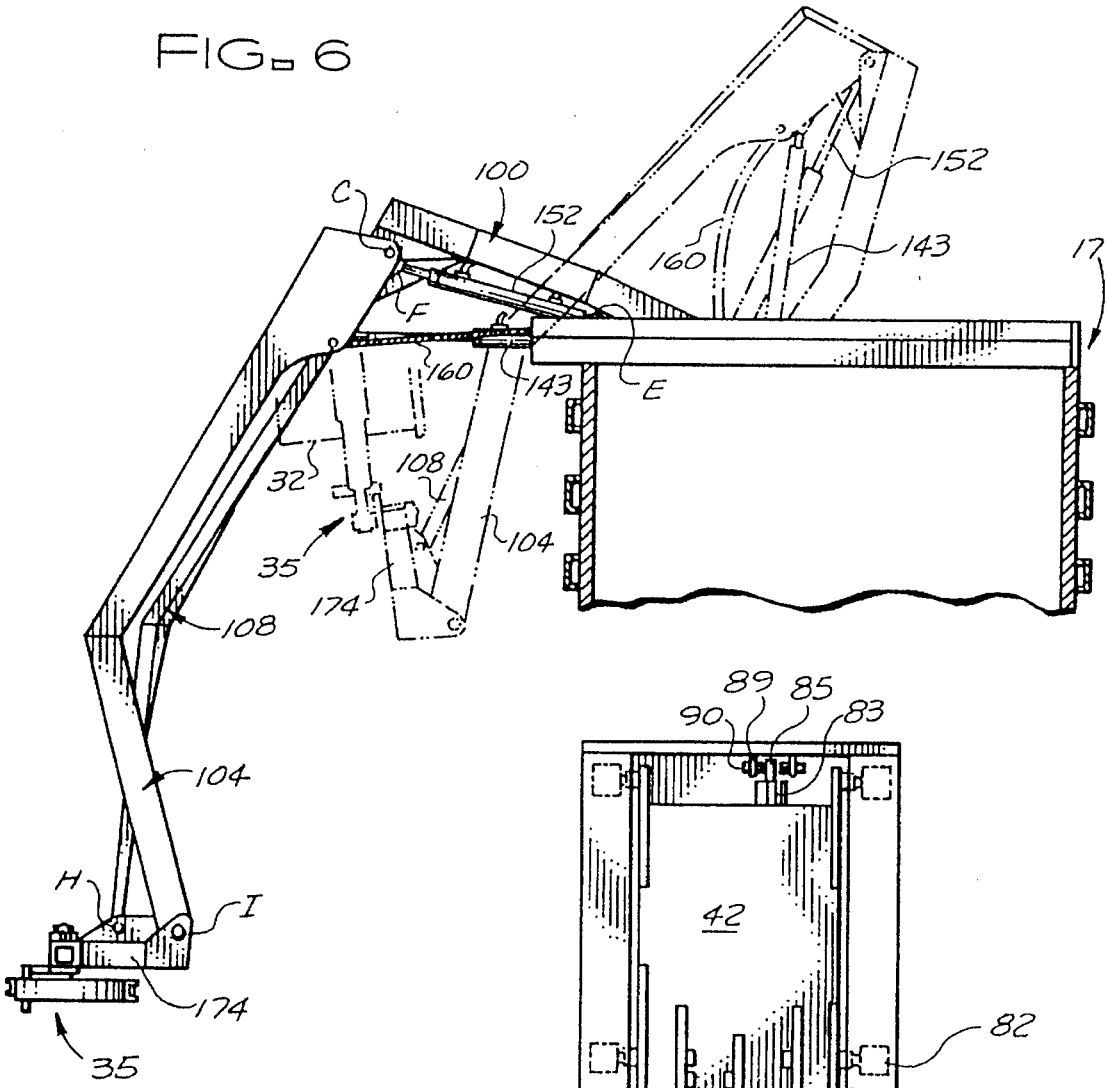
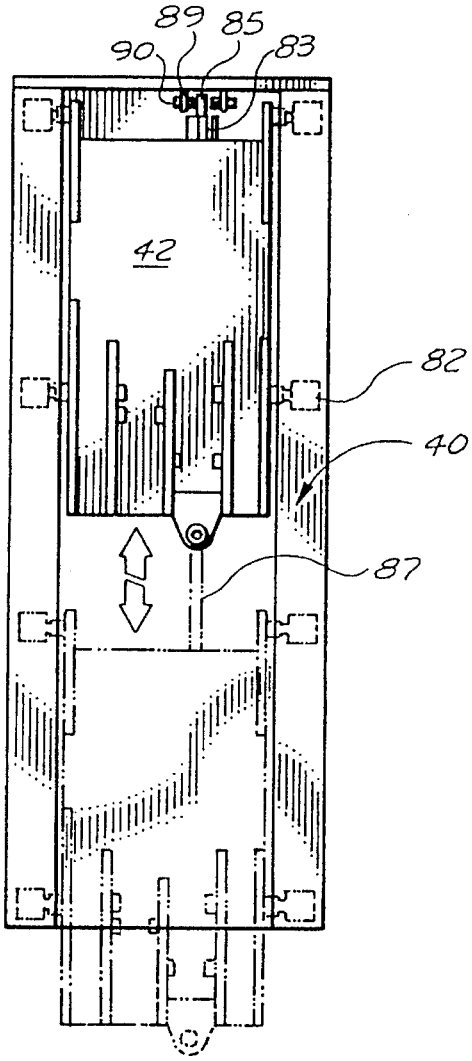
FIG. 5

TOP MOUNTED CONTAINER HANDLING APPARATUS

This application is a division of application Ser. No. 08/036,487, filed Mar. 24, 1993, now U.S. Pat. No. 5,419,671

BACKGROUND OF THE INVENTION

1. Field of the Invention

The present invention relates to refuse collection apparatus.

More specifically, the present invention relates to lifting apparatus typically fitted to refuse collection vehicles for gripping and dumping refuse containers.

In a further and more particular aspect, the instant invention concerns an elevated container handling apparatus especially adapted to be mounted, preferably to the top of a refuse collection vehicle.

2. Prior Art

Collection of waste has long been a problem, and will continue to be a problem into the foreseeable future. Waste collection has become highly sophisticated, mechanized and automated, in an attempt to reduce labor costs and increase efficiency. However, while these goals have been achieved to some degree, many problems effecting efficiency still exist. The equipment used is very expensive, and any increase in efficiency will result in a substantial savings in costs.

Initially, refuse is deposited and temporarily stored in a conveniently located refuse container. Subsequently, the contents of the refuse container are received by a refuse collection vehicle for ultimate transfer to a disposal site.

The conventional refuse collection vehicle basically includes a cab, a body and a container handling apparatus carried upon a wheeled chassis. The container handling apparatus is controllably actuated in response to an on-board source of pressurized hydraulic fluid selectively directed by a control located at the operator's compartment within the cab. The body is generally bipartite, having a hopper and a stowage bin for respectively receiving and stowing refuse. Refuse handling means, usually termed a packer, transfers and compacts refuse from the hopper to the stowage bin.

Well-known packer mechanisms include the swinging platen, which packs refuse into the stowage bin by pivoting about a central point. It is capable of swinging clockwise as well as counterclockwise, packing refuse in both directions. This permits continuous deposit of refuse, without worrying about the position of the packer. Many refuse collection vehicles, using more traditional packers consisting of a packer panel which is movable from a position at the front of the hopper, to a position at the rear of the hopper towards the stowage bin, moved by a hydraulic cylinder assembly. With this packer, refuse can only be emptied into the hopper when the panel is retracted. If extended, refuse collects behind the packer panel preventing operation of the packer. This problem has been partially solved by employing a follower panel which extends over the top of the hopper when the packer panel is extended. Any refuse dumped at this time collects on the follower panel. When the packer panel is retracted, the follower panel is retracted allowing refuse to spill into the hopper. Thus, continuous deposit of refuse is possible. However, while the follower panel works in theory, when used with a container handling apparatus mounted in a conventional manner to the truck frame between the body and the cab, smooth operation of the panel is hindered. The presence of the container handling apparatus, which often extends upward between the body and cab, prevents the follower panel from retracting forward over the cab. Therefore, expensive and somewhat ineffective modification are required such as shortening or angling of the follower panel upward in order to clear the container handling apparatus.

Other problems associated with conventional container handling apparatus include a limited reach, a space requirement between the cab and body of the refuse collection vehicle, and complexity of the mechanism. Many of the current container handling mechanisms have a very limited reach capability, due to their positioning near the ground. The space required between the cab and body, shifts the body rearward, lengthening the wheelbase, or reducing the body length, reducing efficiency due to improper weight distribution or reducing payload. The space requirement also prohibits retrofitting container handling apparatus on vehicles without the space. Also, the complexity of many container handling mechanisms increase costs and reduce reliability of the mechanism. Many employ slides, rollers, and chains, which are subject to durability problems. Furthermore, installing container handling mechanisms mountable to the frame between the cab and body is expensive. Generally, installation occurs in what is referred to as a job shop. What this amounts to is a custom installation, which occurs after the construction of the refuse collection vehicle on an assembly line. The cost is substantially higher than an assembly line.

It would be highly advantageous, therefore, to remedy the foregoing and other deficiencies inherent in the prior art.

Accordingly, it is an object of the present invention to provide a new and improved container handling apparatus.

Another object of the present invention is to provide a container handling apparatus mountable to an elevated position above the floor of the body of a refuse collection vehicle.

And another object of the present invention is to provide a container handling apparatus which may be prefabricated on a body, saving mounting time and reducing expense since it can be prefabricated on an assembly line instead of mounted at a job shop.

Another object of the present invention is to provide a container handling apparatus which may be retrofitted to substantially any refuse collection vehicle.

Still another object of the present invention is to provide a top mounted container handling apparatus which allows the body of a refuse collection vehicle to be moved forward for better weight distribution.

Yet another object of the present invention is to provide a top mounted container handling apparatus which has an extended reach capability.

Yet still another object of the present invention is to provide a top mounted container handling apparatus which will work with substantially any packing system allowing use of a more effective follower panel.

A further object of the present invention is to provide a top mounted container handling apparatus which can be used to replace a conventional breaker beam.

And a further object of the present invention is to provide a top mounted container handling apparatus which generates a lift motion entirely by linkages.

Yet a further object of the present invention is to provide a top mounted container handling apparatus requiring no slides, chains, or rollers, thereby increasing durability.

SUMMARY OF THE INVENTION

Briefly, to achieve the desired objects of the instant invention in accordance with a preferred embodiment thereof, provided is a mounting platform, and a master bar having a first end and a second end with the first end pivotally coupled to the mounting platform. Further provided is a gripper base having a first end and a second end, a support link having a first end and a second end, the first end pivotally coupled to the second end of the master bar and a second end pivotally coupled to a second end of the gripper base, and a tension link having a first end and a second end, the first end pivotally coupled to the second end of the master bar and the second end pivotally coupled to the first end of the gripper base. An extension cylinder is coupled between the mounting platform and the support link intermediate its first and second ends and a hoist cylinder is mounted between the mounting platform and the first end of the support link.

The above objects and advantages are further realized in methods of using the container handling apparatus.

BRIEF DESCRIPTION OF THE DRAWINGS

The foregoing and further and more specific objects and advantages of the instant invention will become readily apparent to those skilled in the art from the following detailed description of the preferred embodiment thereof taken in conjunction with the drawings in which:

FIG. 5 is a top plan view of the mounting platform, illustrating the extended and retracted positions of the carriage; and FIGS. 6 and 7 are side views of the top mounted container handling apparatus illustrating the extended and the dump positions.

DETAILED DESCRIPTION OF THE PREFERRED EMBODIMENT

Figure 1:
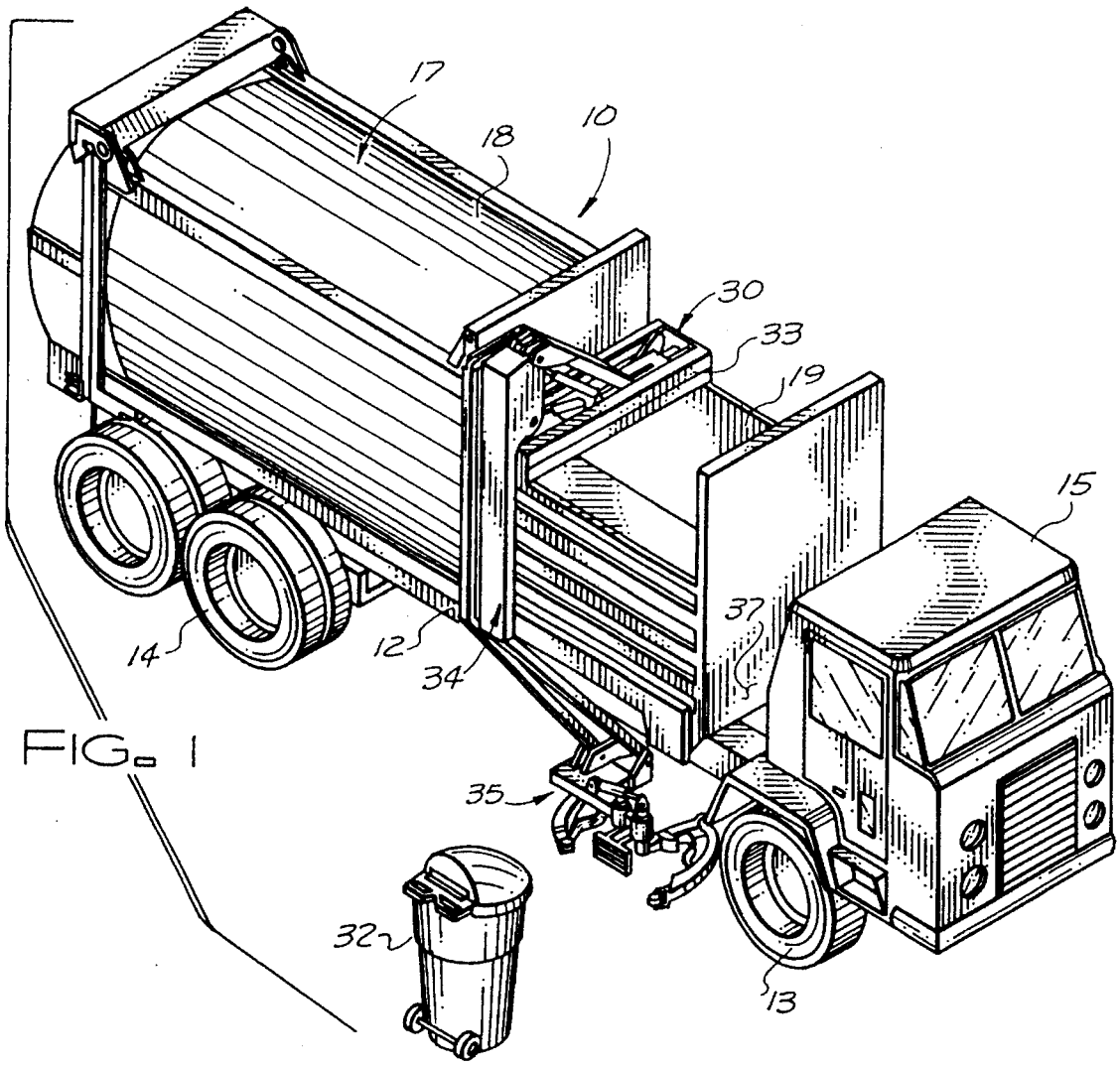
FIG. 1 is a perspective view of a top mounted container handling apparatus, constructed in accordance with the teachings of the instant invention, as it would appear mounted on a refuse collection vehicle in a retracted position.

Turning now to the drawings in which like reference characters indicate corresponding elements throughout the several views, attention is first directed to FIG. 1 which illustrates a conventional prior art refuse collection vehicle generally designated by the reference character 10. Refuse collection vehicle 10 is viewed from the curb side, and includes a frame 12 supported and mobilized by a plurality of wheels including front wheels 13 and rear wheels 14 having complementary mirror images on the opposite or street side of vehicle 10.

A cab 15 and body 17 are carried upon frame 12. Cab 15 enclosing an operator's compartment, resides proximate the forward end of frame 12. Body 17, located upon the rearward portion of frame 12, includes a stowage bin 18 and hopper 19. Although not specifically illustrated, those skilled in the art will understand that hopper 19 located forwardly of stowage bin 18, includes means for compacting and stowing refuse within stowage bin 18.

Set forth for purposes of orientation and reference in connection with the ensuing detailed description of the preferred embodiment of the instant invention, the foregoing brief description of refuse collection vehicle 10 is intended to be generally representative of typical, prior art, commercially available vehicles of the type. Details not specifically illustrated and described will be readily understood and appreciated by those skilled in the art.

With continued reference to FIG. 1, there is seen a top mounted container handling apparatus, generally designated by the reference character 30 for lifting a refuse container 32 and dumping the contents thereof into hopper 19. Container handling apparatus 30 includes a mounting platform 33 preferably mounted on top of body 17, a lift arm 34 pivotally coupled to mounting platform 33 and terminating in a container engaging mechanism 35 which may be a conventional gripping mechanism. While mounting platform 33 is illustrated attached to the top portion of body 17 proximate the rear portion of hopper 19 adjacent stowage bin 18, those skilled in the art will understand that mounting platform 33 may be attached forwardly or rearwardly of its present position such as to a forward portion of hopper 19. Furthermore, it will be understood that container handling apparatus 30 may be mounted in substantially any position elevated above frame 12.

Container handling apparatus 30 has an extended and retracted position as well as a hoist position. These will be discussed in greater detail below, however, with reference to FIG. 1, it can be seen that in the retracted position lift arm 34 extends downward along the sides of body 17, with container engaging mechanism 35 positioned below and somewhat underneath body 17.

Those skilled in the art will also note that a space 37 between body 17 and cab 15 need not be large enough to accommodate a container handling apparatus, as in the prior art, but can be relatively nonexistent, allowing body 17 to be shifted forward on frame 12 to provide better weight distribution and a shorter wheel base.

Figure 2:
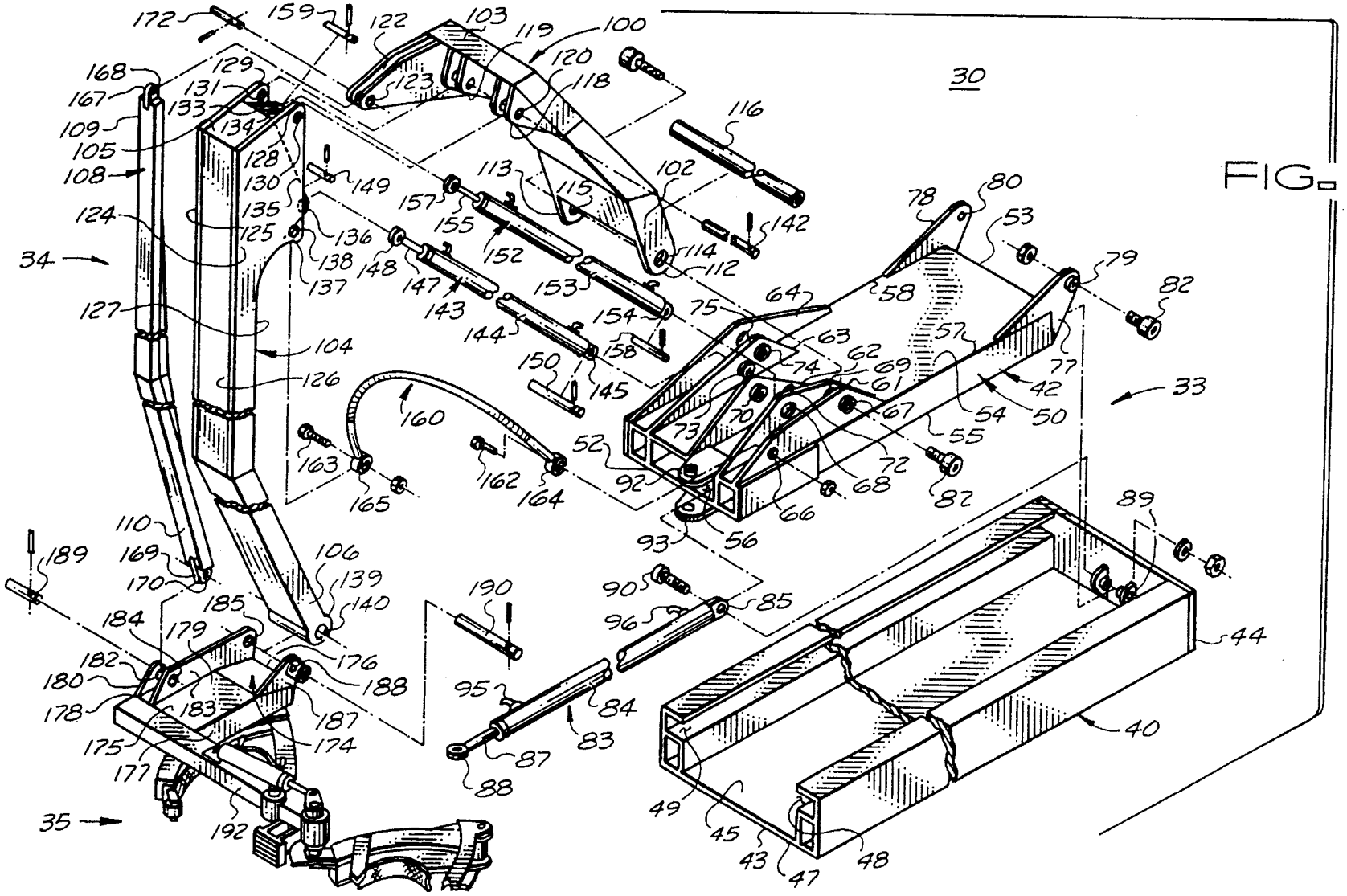
FIG. 2 is an exploded view of the top mounted container handling apparatus.

Referring now to FIG. 2, container handling apparatus 30 includes mounting platform 33 having a base 40 and a carriage 42 preferably extendably received by base 40. Base 40 has a curb or right end 43, a street or left end 44, a top surface 45 and a bottom surface 47. Raised carriage slots 48 and 49 extend upward from opposing edges of top surface 45, facing inward, each extending from curb end 43 to street end 44. Base 40 is preferably mounted rearward on top of hopper 19, adjacent stowage bin 18, with bottom surface 47 resting on the top of hopper 19. In this position, base 40 can double as a breaker beam against which objects extending from the top of hopper 19 are sheared off. The packer panel (not shown) forces refuse into stowage bin 18, and objects extending outward therefrom are sheared off between the breaker beam, in this embodiment base 40, and the packer panel.

Carriage 42 consists of a carriage base 50 having a curb end 52, a street end 53, a top panel 54, a bottom panel 55, a front edge 57, and a back edge 58. Top panel 54 and bottom panel 55 are separated in a parallel spaced apart relationship by a space 56. A plurality of plates 60, 61, 62, 63 and 64 extend upward from top panel 54 beginning with plate 60 extending upward proximate front edge 57. Plates 61, 62, 63 and 64 extend upward progressively across top panel 54 in a spaced apart manner, with plate 64 extending upward proximate back edge 58. Plates 60, 61, 62, 63, and 64 each extend upward from top panel 54 proximate curb end 52 and extend toward street end 53 to a point intermediate curb end 52 and street end 53.

A bore 66 extends through plate 60 proximate curb end 52 and a bore 67 extends through plate 60 proximate its opposing end towards street end 53. A bore 68 extends through plate 61 intermediate a curb end and street end thereof and a bore 69 extends through plate 61 proximate street end 53. Bores 70 and 72 extend through plate 62 with bore 70 intermediate the curb end and the street end thereof and bore 72 proximate the street end thereof. Bores 73 and 74 extend through plate 63, bore 73 intermediate curb and street ends, and bore 74 proximate the street end. A bore 75 extends through plate 64 intermediate the curb and street ends. The purpose of each bore will be revealed as a description of the preferred embodiment progresses.

Additionally, plates 77 and 78 extend upward from street end 53 proximate front edge 57 and back edge 58 respectively. A bore 79 extends through plate 77, and a corresponding bore 80 extends through plate 78.

Carriage 42 is slidably mounted on carriage base 50 and may be moved between a retracted and extended position. cam followers 82 are mounted on carriage 42 extending outward from bores 67, 75, 79 and 80 of plates 60, 64, 77, and 78 respectively. Cam followers 82 are received by carriage slots 48 and 49 of base 40. Cam followers 82 suspend carriage 42 within base 40, allowing sliding movement thereof. Carriage 42 is moved between the retracted and extended position by actuating means, which in this preferred embodiment is a cylinder assembly 83. Cylinder assembly 83, in this embodiment, is a conventional double acting hydraulic cylinder including a cylinder 84 having an attachment member 85 coupled to one end and an operating rod 87 extending from the opposing end and having a free end 88. Cylinder assembly 83 is received within space 56 of carriage 42, with attachment member 85 of cylinder 84 received by a bifurcated bracket 89 extending upward from street end 44 of base 40, and a nut and bolt assembly 90 extending through bifurcated bracket 89 and attachment member 85, securing it thereto. Free end 88 of operating rod 87 is received and secured between plates 92 and 93 which extend in a curb side direction from the curb end of top panel 54 and bottom panel 55 respectively.

Hydraulic cylinder assembly 83 is of the double acting type whereby operating rod 87 can be driven in reciprocal directions, in response to selective directional application of pressurized hydraulic fluid injected into cylinder 84 through hoses 95 and 96 as will be readily appreciated by those skilled in the art. The extension of cylinder assembly 83 moves carriage 42 outward from base 40 into an extended position. Retraction of cylinder assembly 83 moves carriage 42 into the retracted position. This movement is illustrated in FIG. 5.

It will be understood by those skilled in the art, that while a carriage is movably mounted on a base in the preferred embodiment, the carriage may be omitted from the mounting platform, with the elements that extend from the carriage extending from a fixed base instead. This would eliminate the additional reach, but would be lighter and less expensive.

Container handling apparatus 30 further consists of lift arm 34 including a master bar 100 having a first end 102 pivotally coupled to carriage 42 and a second end 103, a support link 104 having a first end 105 pivotally coupled to second end 103 of master bar 100 and a second end 106, and a tension link 108 having a first end 109 coupled to second end 103 of master bar 100 substantially adjacent support link 104 and a second end 110.

Master bar 100 is a flattened elongate member with a pair of spaced apart lugs 112 and 113 extending from first end 102, with bores 114 and 115 extending therethrough. Lugs 112 and 113 are received between plates 60, 61 and plates 63, 64 respectively, and pivotally secured by a pin 116 received through bores 67, 69, 74 and 75 of plates 60, 61, 63 and 64 and bores 115 and 116 of lugs 112 and 113. Cam followers 82 rotate freely, and threadably engage the end of pin 116, retaining it in position. A pair of spaced apart bifurcated brackets 118 and 119 having a bore 120 extending completely therethrough extend substantially perpendicularly outward from second end 103 proximate the forward edge of master bar 100, and an extended bifurcated bracket 122 having a bore 123 extending therethrough, extends substantially perpendicularly outwardly past brackets 118 and 119 from second end 103 proximate the back edge of master bar 100.

Support link 104 is an elongate member having a front side 124 and a back side 125, a curb side 126 and a street side 127. A pair of lugs 128 and 129 having bores 130, 131 extending therethrough respectively, extend substantially perpendicularly from street side 127 proximate first end 105 and front and back side 124 and 125 respectively. A bifurcated bracket 133 having a bore 134 extending therethrough extends from street side 127 proximate first end 105 below and between lugs 128 and 129. A bifurcated bracket 135 having a bore 136 extending therethrough, projects from street side 127 spaced from bifurcated bracket 133 towards second end 106 of support link 104. A lug 137 extends from street side 127 of support link 104 proximate bifurcated bracket 135, and has a bore 138 extending therethrough. Second end 104 of support link 104 terminates in a lug 139 through which a bore 140 extends.

Still referring to FIG. 2, lugs 128 and 129 are received by bifurcated brackets 118 and 119 respectively. A pin 142 extends through bores 130 and 131 of lugs 128 and 129, and bore 120 of bifurcated brackets 118 and 119, pivotally securing first end 105 of support link 104 thereto. Support link 104 is movable between an extended position and a retracted position by an extension cylinder assembly 143. Extension cylinder assembly 143 consists of a cylinder 144 with an attachment member 145 coupled to one end and an operating rod 147 extending from an opposing end. Operating rod 147 has a free end 148 receivable by bifurcated bracket 135. A pin 149 is inserted through bore 136 of bifurcated bracket 135 and free end 148 of operating rod 147, pivotally securing free end 148 thereto. The opposing end of extension cylinder assembly 143 is secured to carriage 42 with attachment member 145 of cylinder 144 received between plates 62 and 63. A pin 150 extends through bores 72 and 73 of plates 62 and 63, and attachment member 145, pivotally securing extension cylinder assembly 143 to carriage 42. A hoist cylinder assembly 152 having a cylinder 153 with an attachment member 154 coupled to one end and operating rod 155 having a free end 157 extending from the opposite end of cylinder 153, pivots master bar 100 from a lowered to a raised position for dumping refuse container 32. Attachment member 154 is received between plates 61 and 62, and is pivotally secured by a pin 158 extending through bores 68, 70 or plates 61 and 62, and attachment member 154. Free end 157 is received between bifurcated bracket 133 and pivotally secured by a pin 159 extending through bore 134 of bifurcated bracket 133 and free end 157.

A limiting member 160 which, in this preferred embodiment is a length of cable, has an attachment member 164 at one end and an attachment member 165 at the opposing end. Limiting member 160 is coupled between support link 104 and carriage 42 to prevent over extension of lift arm 34 which will be discussed in greater detail below. Attachment member 164 is coupled to plate 60 by a nut and bolt assembly 162 extending through attachment member 164 and bore 66. Attachment member 165 is coupled to lug 137 by a nut and bolt assembly 163 extending through attachment member 165 and bore 138.

Tension link 108 extends substantially parallel to support link 104, and is an elongate member having a lug 167 with a bore 168 therethrough at first end 109 and a lug 169 having a bore 170 therethrough at second end 110. Tension link 108 is pivotally coupled to master bar 100, with lug 167 received within bifurcated bracket 122, and pivotally secured by a pin 172 extending through bore 123 of bifurcated bracket 122 and bore 168 of lug 167.

Gripping mechanism 35 is coupled to lift arm 34 by a gripper base 174. Gripper base 174 has a curb end 175, a street end 176, a front edge 177, a back edge 178, and a top surface 179. Gripper base 174 is pivotally coupled to second ends 106 and 110 of support link 104 and tension link 108 respectively and couples gripping mechanism 135 to lift arm 34. A plate 180 having a bore 182 extending therethrough projects upwardly from top surface 179 along back edge 178 of gripper base 174 proximate curb end 175. A plate 183 projects upward from top surface 179 extending from curb end 175 to street end 176 substantially parallel to plate 180. A bore 184 extends through plate 183 proximate curb end 175, aligned with bore 182, and a bore 185 extends through plate 183 proximate street end 176. A plate 187 projects upward from top surface 179 of gripper base 174 proximate street end 176 and extending partially along front edge 177. A bore 188 extends through plate 187, in alignment with bore 185. Gripper base 174 is carried at second ends 106 and 110 of support link 104 and tension link 108 respectively, with lug 169 received between plates 180, 183, and rotatably secured by a pin 189 inserted through bores 182, 184 and 170. Lug 139 is received between plates 183 and 187, and rotatably secured by a pin 190 inserted through bores 185, 188 and 140.

A mounting beam 192 of gripping mechanism 35 is affixed to gripper base 174. Those skilled in the art will understand that mounting beam 192 may be configured to accommodate substantially any conventional gripping mechanism for use with lift arm 34. Therefore, a detailed description of gripper mechanism 35 has been excluded since one skilled in the art would be familiar with the gripping mechanisms coupled to lift arm 34.

Figure 3:
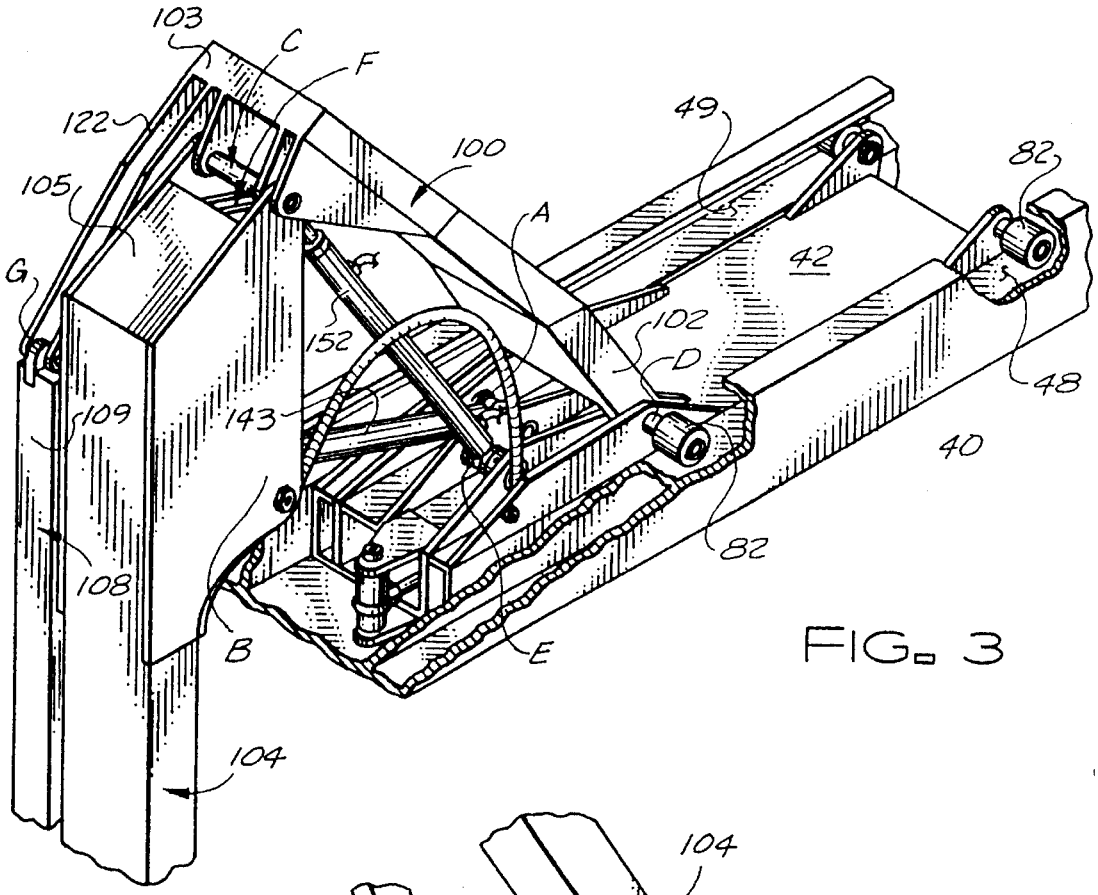
FIG. 3 is a perspective view illustrating the top portion of top mounted container handling apparatus.
Figure 4:
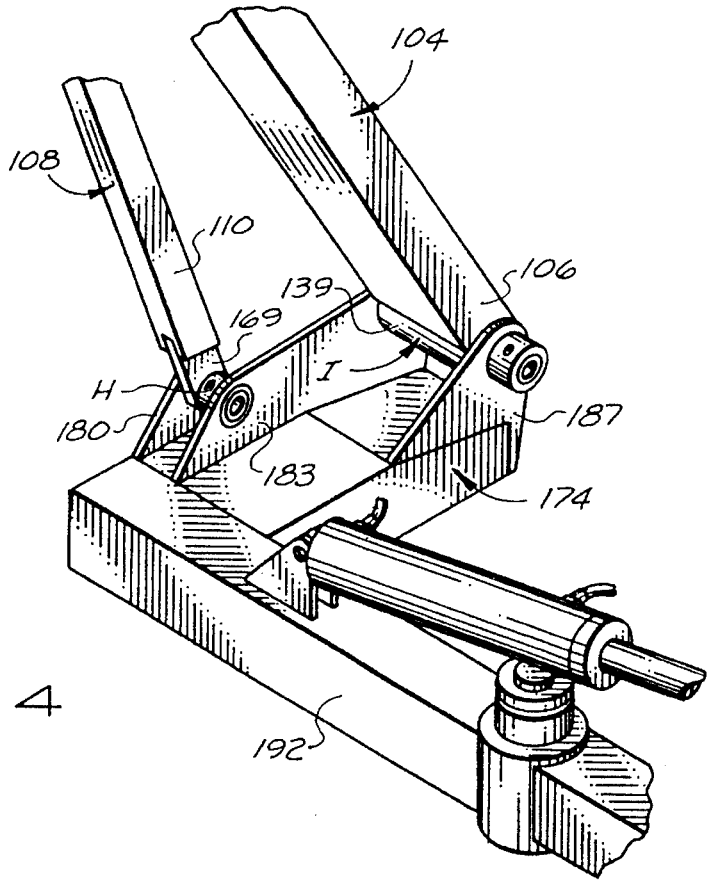
FIG. 4 is a perspective view illustrating the lower portion of the top mounted container handling apparatus specifically, the couplings of the gripper base to the lower portions of the support link and the tension link.

Container handling apparatus 30 is configured to form three four-bar linkages, a reach linkage, a hoist linkage, and an angular linkage, which control a reach movement and a hoist or dump movement. Referring now to FIGS. 3 and 4, the hoist linkage consists of four links extending between pivot points. The pivot points in the hoist linkage are A which corresponds to pin 150, B which corresponds to pin 149, C which corresponds to pin 142 and D which corresponds to pin 116. Each of the pins define the axis of rotation for each of the pivot points. Links AB, BC, CD, DA form the hoist linkage. Hoist cylinder assembly 152 operates on the hoist linkage as an actuating mechanism, to hoist the container into a dump position.

The reach linkage consists of pivot points E corresponding to pin 158, F corresponding to pin 159, and C,D as discussed above. Links EF, FC, CD, DE, form the reach linkage. Reach cylinder assembly 143 operates on the reach linkage as an actuating mechanism, to rotate the reach linkage, extending gripping mechanism 35.

The pivot points in the angular linkage are G corresponding to pin 172, H corresponding to pin 189, I corresponding to pin 190, and C as discussed above. Links GH, HI, IC, CG form the angular linkage.

Figure 7:
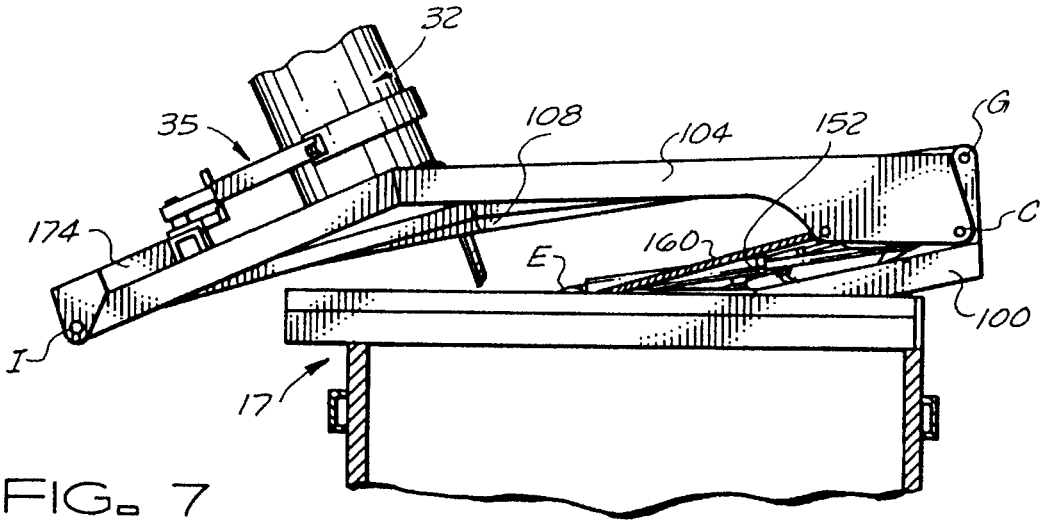

Still referring to FIGS. 3 and 4 with further reference to FIGS. 6 and 7, the operation of the present invention consists of a reach cycle including extending lift arm 34, gripping refuse container 32 and retracting lift arm 34, and a dump cycle includes raising lift arm 34, emptying refuse container 32, and lowering lift arm 34. The motion of the reach cycle is accomplished by the reach linkage and the angular linkage working together. The reach linkage controls the height of gripper base 174 in relation to refuse collection vehicle 10 as the lift is extended and retracted and the angular linkage controls the level motion of gripper base 174, keeping it in a substantially horizontal attitude during the extension and retraction of the lift.

Those skilled in the art will understand that pressurized hydraulic fluid is used for selective actuation of extension cylinder assembly 143 and hoist cylinder assembly 152, supplied by an on-board source and respond to controls located at the operator's station within cab 15 or otherwise mounted on refuse collection vehicle 10. Neither the source of pressurized hydraulic fluid nor the controls are specifically illustrated.

The motion of the hoist and dump cycle is accomplished by the hoist linkage and angular linkage working together. The hoist linkage and angular linkage work in unison with each other to control the height and angular rotation of container 32 in response to the extension of hoist cylinder 152. When extension cylinder assembly 143 is in the extended position, such as after initiating the reach cycle, the possibility exists for the operator to leave the extension cylinder assembly 143 in the extended position and subsequently begin the hoist cycle by extending the hoist cylinder assembly 152. This would move container 32 in a path that would exceed a predetermined height barrier, generally a 13'6" height barrier. To insure that this cannot happen, limiting member 160 is coupled between carriage 42 and support link 104. Limiting member 160 gradually collapses extension cylinder assembly 143 as hoist cylinder assembly 152 is extended. Once extension cylinder assembly 143 has been fully collapsed, link AB becomes a standard fixed link. Those skilled in the art will understand that the reach cycle may include retracting extension cylinder assembly 143, thus eliminating the need for limiting member 160, and employing AB as a standard link from the beginning of the hoist cycle.

While limiting member may be used as a safety feature to prevent lift arm 34 from exceeding a specific height, those skilled in the art will understand that limiting member 160 may be replaced by a switch which automatically relieves the hydraulic pressure in extension cylinder assembly 143 causing retraction thereof due to the weight of the container, during the hoist cycle.

One cycle of operation of container handling apparatus 30 would include positioning refuse collection vehicle 10 adjacent container 32. The reach cycle is then initiated by extending operating rod 147 of extending cylinder assembly 143, thus lengthening link AB. This pivots support link 104 outward. Normally, this would result in gripper base 174 swinging in an arcuate path which would end with it at a height above an effective level for gripping container 32. Furthermore, the orientation of gripper base 174 would be tilted, with curb end 175 being higher than street end 176. The amount of extension and orientation of gripper base 174 is controlled by reach linkage EFCD and angular linkage GHIC working in combination. At this point in the cycle, reach linkage EFCD is a standard four-bar linkage, with each of the links of a fixed length. Furthermore, links EF and FC being pivotally connected at F, form a toggle joint. The relative positions of pivot points E, F and C are in toggle when support link 104 is retracted. As support link 104 is moved outwardly, pivot point F comes out of toggle. As it does, it is effectively like shortening link EF. This results in master bar 100 rotating downward, which compensates for the rise resulting from the arcuate path of gripper base 174.

The level attitude of gripper base 174 is maintained by angular linkage GHIC. Angular linkage GHIC forms a quadrilateral with a sum of interior angles equaling 360°. As the angle formed by link HG and GC increases, the angle formed by link GH and HI must decrease. The rate of angular displacement of G is proportional to the rate of angular displacement of C, maintaining link HI at a level attitude such that pivot points H and I travel along a linear path.

When gripper base 174 is in position by container 32, the operator closes gripping mechanism 35 around container 32. The operator can then retract extension cylinder assembly 143 reversing the process discussed above. This begins the dump cycle. The operator now extends hoist cylinder assembly 152 resulting in a dumping motion controlled by hoist linkage ABCD, which is now a standard linkage composed of fixed length links, and angular linkage GHIC. As link EF is lengthened, by extending hoist cylinder assembly 152, master bar 100 is rotated as can be seen by the broken lines in FIG. 6 to a position illustrated in FIG. 7. At this point in the cycle, angular linkage GHIC operates in reverse to that discussed earlier, with the angle formed by link HG and GC decreasing with a corresponding increase in the angle formed by links GH and HI. The operation of angular linkage GHIC results in container 32 being dumped into hopper 19 as illustrated in FIG. 7.

The cycle is then reversed by retracting hoist cylinder assembly 152 pivoting master bar 100 forward, then actuating extending cylinder assembly 143 to replace container 32. Container handling apparatus 30 is then retracted against the side of refuse collection vehicle 10 for transport.

The previous operation cycle describes the operation of container handling apparatus 10 having a fixed mounting platform 33. In other words, carriage 42 would not be extendable, but would be a fixed base. While this has not been illustrated, it is an option if an extended reach is not required. A fixed container handling apparatus 30 would have a reach of approximately 6 feet. As is preferred and illustrated, carriage 42 is extendably mounted on base 40 giving container handling apparatus 10 an overall reach of over 10 feet. The movement of carriage 42 is illustrated in FIG. 5, with carriage 42 shown in the extended position by broken lines. Carriage 42 would be extended after extension cylinder assembly 143 has been fully extended. If this reach is not sufficient, cylinder assembly 83 would be automatically actuated, using control means such as a cascade valve well-known to those skilled in the art, extending carriage 42 outward. The retraction of lift arm 34 would operate in the reverse, with carriage 42 being retracted, then extension cylinder assembly 143 being retracted. Other than the extension of carriage 42, the cycle of operation is substantially identical to that described above.

Having fully described the invention in such clear and concise terms as to enable those skilled in the art to understand and practice the same, the invention claimed is:

1. A method of collecting refuse comprising the steps of:

providing a refuse collection vehicle having a body and a container handling apparatus mounted on top of said body, said container handling apparatus including;

a mounting platform affixed to the top of said body;

a lift arm coupled to said mounting platform and having;

a master bar having a first end and a second end, said first end pivotally coupled to said mounting platform, a gripper base having a first end and a second end, a support link having a first end and a second end, said first end pivotally coupled to said second end of said master bar, and said second end pivotally coupled to said second end of said gripper base, a tension link having a first end and a second end, said first end pivotally coupled to said second end of said master bar, and said second end pivotally coupled to said first end of said gripper base, an extension cylinder having a first end pivotally coupled to said mounting platform spaced apart from said first end of said master bar, and a second end pivotally coupled to said support link intermediate said first and second ends; and a hoist cylinder having a first end pivotally coupled to said mounting platform spaced apart from said first end of said master bar, and a second end pivotally coupled to said first end of said support link, a container engaging mechanism coupled to said lift arm for engaging and emptying containers;

completing a reach cycle including;

extending said lift arm from a retracted position to an extended position;

gripping said refuse container; and retracting said lift arm;

completing a dump cycle including;

hoisting said lift arm to a raised position to empty said refuse container; and moving said lift arm to a lowered position.

2. A method as claimed in claim 1 wherein said step of extending said lift arm and retracting said lift arm includes extending and retracting said extension cylinder respectively, and said step of raising and lowering said lift arm includes extending and retracting said hoist cylinder respectively.

3. A method as claimed in claim 2 further including the steps of:

extending said lift arm to replace said refuse container; and retracting said lift arm for storage.

4. A method as claimed in claim 3 wherein said mounting platform includes:

a base;

a carriage slideably received by said base; and actuator means for moving said carriage between an extended and a retracted position;

and said reach cycle further includes the steps of:

sliding said carriage to an extended position; and returning said carriage to a retracted position.

* * * * *